US008661802B2

(12) United States Patent
Riekers et al.

(10) Patent No.: US 8,661,802 B2
(45) Date of Patent: Mar. 4, 2014

(54) FLANGE PLATE, FLANGE CONNECTION AND EXHAUST MANIFOLD

(75) Inventors: Ralf Riekers, Stuttgart (DE); Angela Hettel, Leinfelden-Echterdingen (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 195 days.

(21) Appl. No.: 13/179,144

(22) Filed: Jul. 8, 2011

(65) Prior Publication Data

US 2012/0006012 A1 Jan. 12, 2012

(30) Foreign Application Priority Data

Jul. 12, 2010 (DE) ..... 10 2010 026 958

(51) Int. Cl.
*F01N 1/00* (2006.01)

(52) U.S. Cl.
USPC ..... 60/323

(58) Field of Classification Search
USPC ..... 60/321, 322, 323; 123/65 FM; 29/890.8; D12/194
See application file for complete search history.

(56) References Cited

U.S. PATENT DOCUMENTS

| | | | | |
|---|---|---|---|---|
| 4,537,027 | A * | 8/1985 | Harwood et al. | 60/323 |
| 4,777,708 | A * | 10/1988 | Harwood et al. | 29/890.08 |
| 6,155,045 | A * | 12/2000 | Durr et al. | 60/323 |
| 6,189,895 | B1 | 2/2001 | Yamada | |
| 6,254,142 | B1 * | 7/2001 | Kaifel et al. | 285/124.1 |
| 6,454,622 | B2 * | 9/2002 | Mashiko et al. | 440/89 R |
| 7,234,302 | B2 * | 6/2007 | Korner | 60/602 |
| 7,926,852 | B2 * | 4/2011 | Geminn | 285/124.1 |
| 2002/0174650 | A1 * | 11/2002 | Durr et al. | 60/323 |
| 2004/0050039 | A1 * | 3/2004 | Matsuda | 60/323 |

FOREIGN PATENT DOCUMENTS

| | | | |
|---|---|---|---|
| DE | 43 13 091 | A1 | 10/1994 |
| DE | 19607184 | C1 | 4/1997 |
| DE | 29717501 | U1 | 11/1997 |
| DE | 10223838 | C1 | 10/2003 |
| EP | 0765995 | A1 | 4/1997 |
| EP | 0861975 | A2 | 9/1998 |
| EP | 1229221 | A1 | 8/2002 |
| FR | 2655382 | A1 | 6/1991 |
| JP | 2001207842 | | 8/2001 |

OTHER PUBLICATIONS

Advertisement for Exhaust Manifold, enclosed.*

* cited by examiner

*Primary Examiner* — Thomas Denion
*Assistant Examiner* — Mickey France
(74) *Attorney, Agent, or Firm* — Reinhart Boerner Van Deuren P.C.

(57) ABSTRACT

The present invention relates to a flange plate for connecting exhaust pipes to a combustion engine, with at least two connecting sockets integrally moulded on the flange plate, on each of which an exhaust pipe can be fastened, and with a plurality of through openings for fixing the flange plate to the combustion engine. Thermal expansion effects can be better compensated if at least one of the connecting sockets is formed in a connecting region, which is surrounded by a slit penetrating the flange plate, wherein the respective slit comprises at least one interruption and the respective connecting region in the region of the respective interruption is connected to the remaining flange plate.

16 Claims, 3 Drawing Sheets

FLANGE PLATE, FLANGE CONNECTION AND EXHAUST MANIFOLD

CROSS-REFERENCE TO RELATED PATENT APPLICATIONS

This patent application claims the benefit of German Patent Application No. 10 2010 026958.1, filed Jul. 12, 2010, the entire teachings and disclosure of which are incorporated herein by reference thereto.

FIELD OF THE INVENTION

The present invention relates to a flange plate for connecting exhaust pipes to a combustion engine. The invention additionally relates to a flange connection for fastening an exhaust system to a combustion engine. Furthermore, the present invention relates to an exhaust manifold for discharging exhaust gas from a combustion engine, particularly of a motor vehicle.

BACKGROUND OF THE INVENTION

An exhaust system is usually fastened at the inlet side to a combustion engine in order to be able to discharge the combustion exhaust gases that accrue during the operation of the combustion engine. The inlet region of the exhaust system fastened to an engine block or to a cylinder bank of the combustion engine is usually formed by a so-called exhaust manifold, which unites a plurality of individual inlet-side exhaust pipes into a common outlet-side exhaust pipe. Usually, the individual exhaust pipes are fastened to the combustion engine by way of a common flange. It is problematic there that in operation of the combustion engine high temperatures develop on the exhaust gas side, which result in thermal expansion effects. Because of different temperatures on the engine block or on the cylinder bank and on the other hand on the flange of the exhaust system or the exhaust manifold and/or due to different heat expansion coefficients of the interconnected components, thermally induced stresses can occur within the interconnected components or within the connection. In particular, these stresses can result in buckling formation in the region of the common flange, so that leakages develop there through which the exhaust gas can escape into the environment untreated. The present invention deals with the problem of showing a way for the connection between exhaust system and combustion engine which is particularly characterized in that the danger of damaging the interconnected components due to the thermal expansion effects is reduced.

According to the invention, this problem is solved through the subjects of the independent Claims. Advantageous embodiments are the subject of the dependent Claims.

SUMMARY OF THE INVENTION

The invention is based on the general idea of providing a flange plate having at least two connecting sockets integrally moulded out of the flange plate on each of which an exhaust pipe can be fastened and which has a plurality of through openings provided for fixing the flange plate to the combustion engine, e.g. suitable for the passing through of screws with at least one connecting region which comprises at least one of the connecting sockets and which is surrounded by a slit penetrating the flange plate. In order for said connecting region to remain connected to the flange plate despite the slit, the respective slit comprises at least one interruption in the region of which the respective connecting region remains connected to the remaining flange plate while it is separated from the flange plate in the remainder, that is along the slit. This design results in that the connecting region with the respective connecting socket can move relative to the remaining flange plate. Because of this, thermally induced expansions can be elastically absorbed as a result of which the danger of critical stresses can be reduced. The invention in this case is based on the consideration that the connecting sockets reach higher temperatures than the flange plate connected to the combustion engine. With the help of the respective slit the respective connecting region containing the respective connecting socket is cut free from the remaining connecting plate except for the respective interruption and separated, so that the connecting sockets with the exhaust pipes fastened thereon can move relative to the remaining connecting plate and thus relative to the combustion engine. Furthermore, especially in the region of the connecting sockets or in the connecting regions the danger of a buckling formation due to thermal expansion effects is significantly reduced.

According to a preferred embodiment the respective slit runs within the flange plate separately and at a distance from socket openings, wherein each socket opening is enclosed by one of the connecting sockets and is penetrating the flange plate. In other words, the respective slit runs out or outwith of the connecting sockets or out or outwith of the socket openings, respectively. Thus, for example, leakage can be avoided or reduced which may occur in case the respective slit would run into such a socket opening or would fluidically connect two of such socket openings with each other.

Additionally or alternatively can be provided that the respective slit runs within the flange plate separately and at a distance from the through openings, i.e. the respective slit runs within the flange plate out or outwith the through openings. Thus, for example, detrimental interaction with the fixation of the flange plate can be avoided or reduced.

Of advantage is further an embodiment, wherein the respective slit at its longitudinal endings is closed or runs into another slit. Consequently, the respective slit runs completely within the flange plate. Thus, for example, leakage can be avoided or reduced.

Practically it can be provided that a width of the respective slit is smaller than a thickness of the flange plate, or that said width at maximum is of the same size as said thickness of the flange plate. Since the slits are provided in order to provide a separation of plate areas neighboring laterally along the length of the slit a small width is sufficient. At certain temperatures said width also can be reduced to zero, such that said plate areas are abutting each other within the slit. For example the slits can be manufactured by means of a laser cutting method or by means of a punching or die cutting method or a cutting method or a separating method.

Particularly advantageous is an embodiment, wherein the through openings are arranged outside the respective connecting region in the remaining flange plate. Thus, in the assembled state, the remaining flange plate is position-fixed on the combustion engine in the region of the through openings, while the connecting regions largely cut free can move relative thereto.

With another advantageous embodiment a plurality of connecting sockets can each be formed in such a connecting region. Preferably all connecting sockets are each formed in such a connecting region. Thus, all connecting sockets can move relative to the remaining flange plate.

With another advantageous embodiment at least one such interruption can be arranged between the respective connecting socket and one through opening adjacent thereto. This is particularly advantageous since the respective through opening represents a fastening point in which the position fixing between the combustion engine and the flange plate takes place. Thus, no or only relatively small relative movements occur between flange plate and combustion engine in operation in the region of the respective fastening opening so that the danger of critical component stresses in the region of the respective interruption is reduced.

With another embodiment at least one such slit can comprise at least one circular arc shaped portion which is arranged coaxially to the respective connecting socket. The shaping of the slit in this case substantially follows the expected heat distribution in the flange plate. Expected is a substantially concentric heat propagation from the respective connecting socket so that a temperature gradient orientated radially to the connecting socket is created. Through the orientation of the slits concentrically to the respective connecting socket they extend substantially perpendicularly to the temperature gradient and thus substantially along isothermal regions. This results in a reduction of thermally induced stresses within the flange plate.

According to an advantageous embodiment, at least one such connecting region can comprise at least one tongue which extends from the associated connecting socket in the direction of an adjacent connecting socket. Because of this, the regions of the flange plate located between adjacent connecting sockets are caught within the flange plate and assigned to at least one of the connecting regions largely cut free. Thus, these regions, too, can move relative to the remaining flange plate.

Practically, the respective slit in this case can surround the respective tongue without interruption. Thus, the respective tongue is quasi cut free relative to the remaining flange plate, which makes possible an improved movability of the tongue relative to the remaining flange plate.

Optionally it can be provided in the region of such a tongue to let the slits of the associated adjacent connecting regions merge into each other and/or to provide these with a common portion. Because of this, particularly large relative movements between the regions of the flange plate adjoining one another via a slit are made possible.

According to another advantageous embodiment at least one such connecting region can comprise a connecting web in the region of at least one such interruption, which with respect to the associated connecting socket substantially extends radially in the direction of an adjacent through opening and which is laterally surrounded by slit portions, which extend particularly parallel to the respective connecting web. For such a slit geometry the movability of the connecting regions largely cut free is improved relative to the remaining flange plate.

The problem on which the invention is based is solved within a flange connection that serves for fastening an exhaust system to a combustion engine through the use of a flange plate of the type described above, on the connecting socket of which exhaust pipes of the exhaust system are fastened. The flange connection in addition to the flange plate comprises at least one pressure plate which is arranged on the flange plate on a side facing away from the combustion engine and which is screwed to the combustion engine through the through openings of the flange plate. In particular, such a pressure plate can comprise at least one through opening through which the respective connecting socket is connected to the respective connecting pipe. To this end, the respective connecting socket protrudes into this through opening of the respective pressure plate or through said pressure plate.

The problem on which the invention is based is also solved by an exhaust manifold which serves for discharging exhaust gas from a combustion engine, particularly of a motor vehicle, wherein the exhaust manifold comprises a plurality of exhaust pipes each of which can be fluidically connected to a combustion chamber of a cylinder of the combustion engine. The exhaust manifold according to the invention now comprises a flange plate of the type described above whose connecting sockets are connected to the exhaust pipes in a fixed manner.

It is clear that the present invention in principle also relates to an exhaust system for a combustion engine, particularly of a motor vehicle having such an exhaust manifold.

Further important features and advantages of the invention are obtained from the subclaims, from the drawings and from the corresponding Figure description by means of the drawings.

It is to be understood that the features mentioned above and still to be explained in the following cannot only be used in the respective combination stated but also in other combinations or by themselves without leaving the scope of the present invention.

BRIEF DESCRIPTION OF THE DRAWINGS

Preferred exemplary embodiments of the invention are show in the drawings and are explained in more detail in the following description, wherein same reference characters relate to same or similar or functionally same components.

It shows, in each case schematically.

While the invention will be described in connection with certain preferred embodiments, there is no intent to limit it to those embodiments. On the contrary, the intent is to cover all alternatives, modifications and equivalents as included within the spirit and scope of the invention as defined by the appended claims

DETAILED DESCRIPTION OF THE INVENTION

Figure 1:
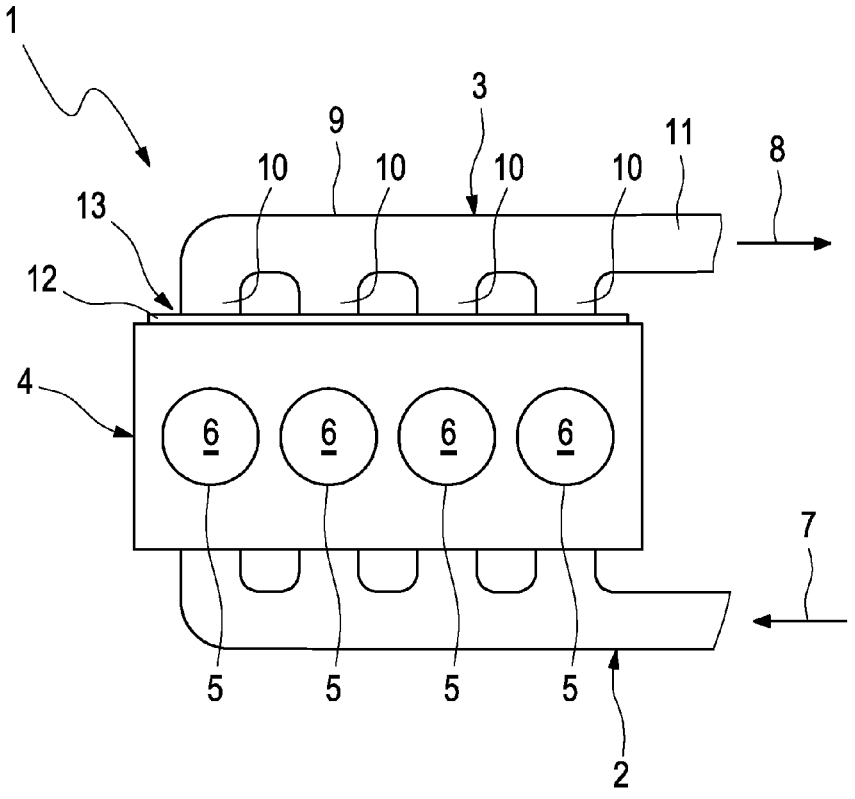
FIG. 1 is a greatly simplified schematic representation of a combustion engine with exhaust system.

According to FIG. 1, a combustion engine 1 can be equipped in the usual manner with a fresh air system 2 and with an exhaust system 3. In the example, the combustion engine 1 comprises an engine block 4 containing a plurality of cylinders 5, each of which surrounding a combustion chamber 6. Instead of an individual cylinder block 4 the combustion engine 1 can also comprise two cylinder banks, for example in the case of a V-engine.

The fresh air system 2 serves for feeding fresh air 7 to the cylinders 5 or to the combustion chambers 6. To this end, the fresh air system 2 on the outlet side is fastened to the engine block 4.

The exhaust system 3 serves for discharging exhaust gas 8 from the cylinders 5 or from the combustion chambers 6. To this end, the exhaust system 3 is fastened to the engine block 4 on the inlet side. The exhaust system 3 on the inlet side comprises an exhaust manifold 9 having an exhaust pipe 10 for each cylinder 5 and is connected to the remaining exhaust system 3 via a common pipe 11. In addition, the exhaust manifold 9 comprises a flange 12 with which the exhaust pipes 10 of the exhaust manifold 9 are fastened to the engine block 4. With the help of this flange 12 a flange connection 13 for fastening the exhaust system 3 to the combustion engine 1 or to its engine block 4 is thus realised.

Preferred embodiments of this flange connection 13 are explained in more detail with reference to FIGS. 2 and 4.

Figure 2:
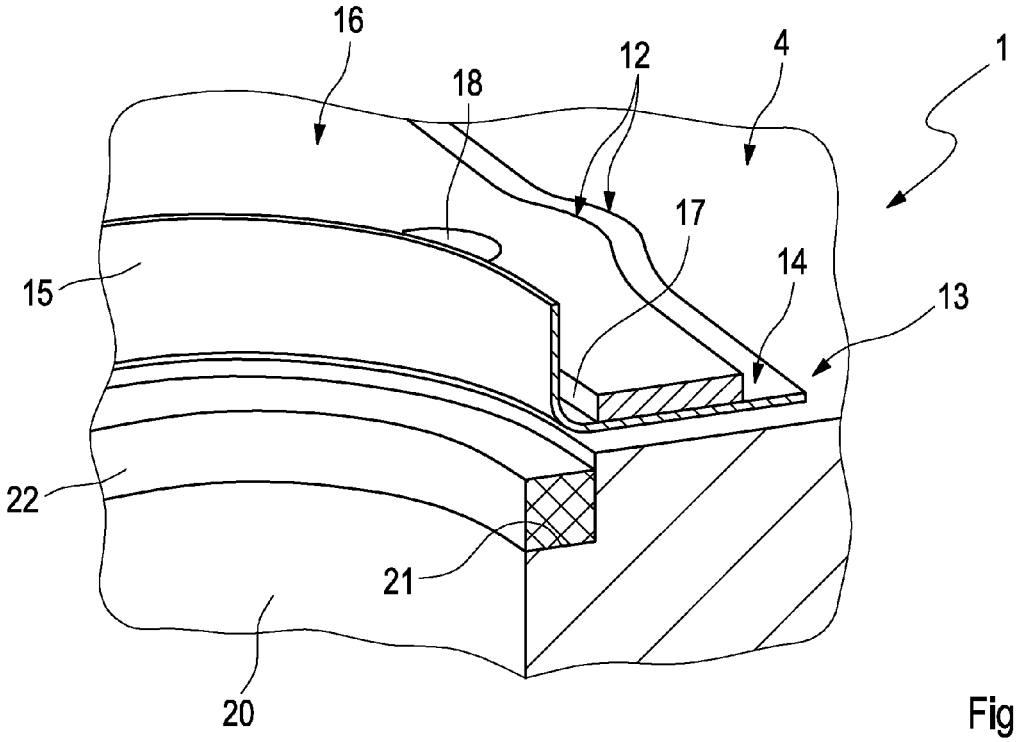
FIG. 2 is a perspective representation in the region of a flange connection.
Figure 3:
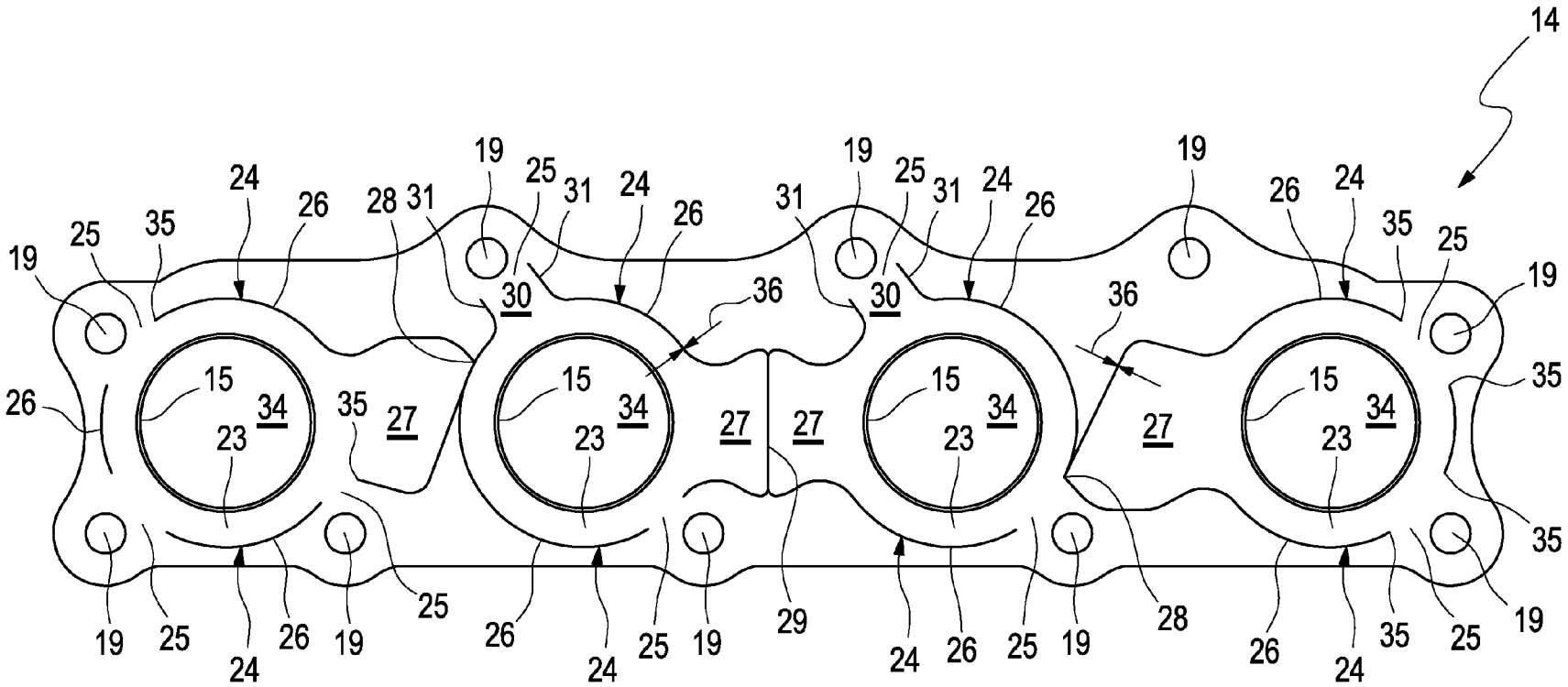
FIG. 3 is a top view of a flange plate.
Figure 4:
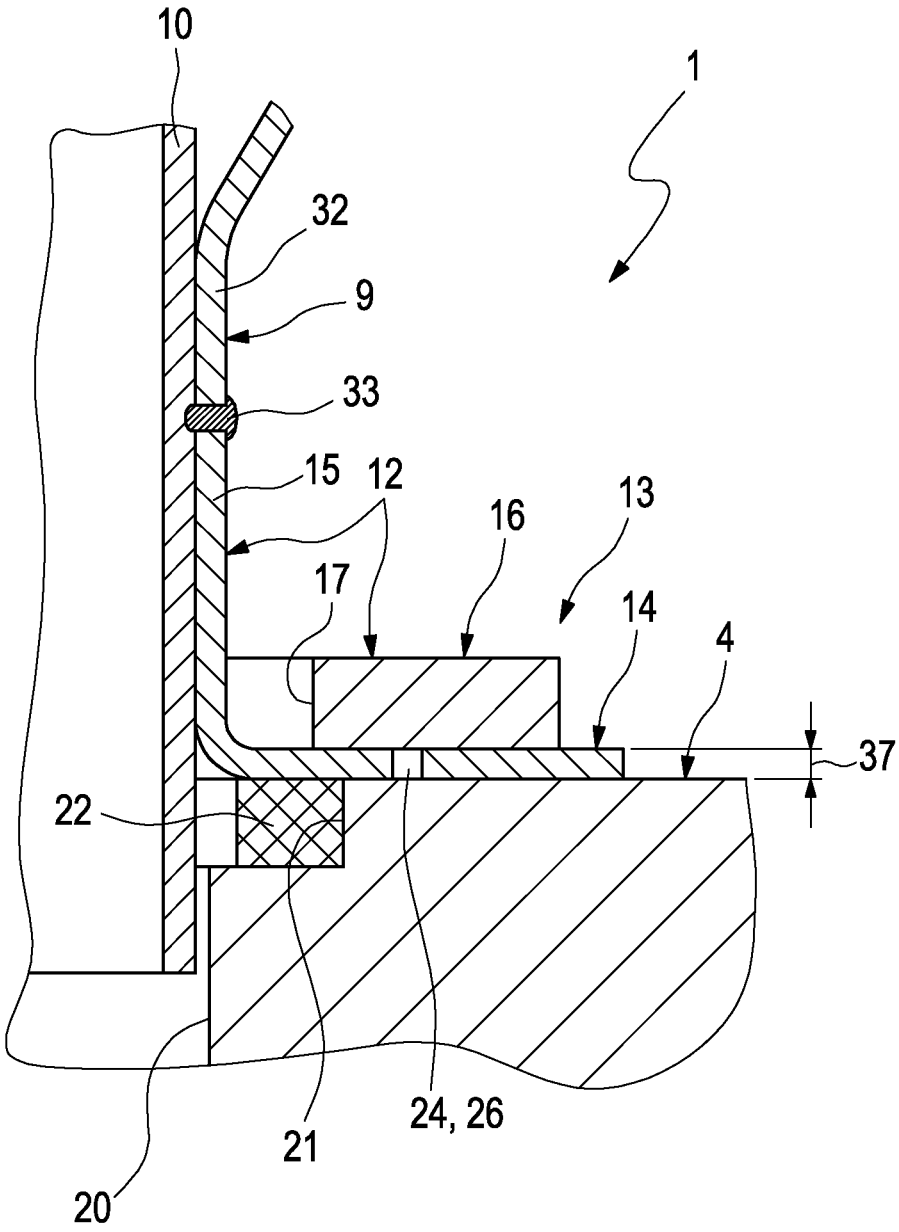
FIG. 4 is a sectional representation as in FIG. 2, however with another embodiment.

According to FIGS. 2 and 4, the flange connection 13 comprises a flange plate 14 which is also shown in FIG. 3. The flange plate 14 comprises a connecting socket 15 for each exhaust pipe 10, on which the respective exhaust pipe 10 can be fastened. Furthermore, the flange connection 13 according to FIGS. 2 and 4 comprises at least one pressure plate 16 which is arranged within the flange connection 13 on the flange plate 14 on a side facing away from the combustion engine 1 or from the engine block. The pressure plate 16 in this case is fastened to the combustion engine 1 or to the engine block 4 through the flange plate 14.

The pressure plate 16 comprises at least one large opening 17 through which the connecting socket 15 protrudes through the flange plate 14. Furthermore, the pressure plate 16 comprises at least one small opening 18, through which a screw or threaded rod for screwing the pressure plate 16 to the engine block 4 can be passed. In order for this screw connection through the flange plate 14 to be possible, the flange plate 14 according to FIG. 3 has a plurality of through openings 19, through which the respective screw or threaded rod can be guided. Consequently, the respective through opening 19 serves for the fixing of the flange plate 14 on the engine block 4 or on the combustion engine 1.

The respective small opening 18 of the pressure plate 16 in this case is arranged aligned with one of the through openings 19 of the flange plate 14.

The flange 12 is thus ultimately formed through the flange plate 14 and the at least one pressure plate 16.

Evidently, the flange plate 14 in this case can be thinner than the pressure plate 16, for example at a ratio of 2/3. For example, the flange plate 14 has a thickness of 2 mm, while the pressure plate 16 has a thickness of 3 mm. More preferably, the pressure plate 16 is designed as sheet metal part or shaped sheet metal part.

In the region of the respective connecting socket 15 the engine block 4 comprises an outlet opening 20 which leads to the respective cylinder 5 or to the respective combustion chamber 6. In the example, the engine block 4 additionally comprises a ring step 21 in the region of the outlet opening 20, in which a gasket 22, more preferably a carbon gasket, is inserted. For example, the respective exhaust pipe 10 can protrude through the connecting socket 15 as far as into the region of the outlet opening 20 so that the gasket 22 then radially comes to bear against the respective exhaust pipe 10 in a sealing manner. In the example of FIG. 4, the exhaust pipe 10 protrudes into the outlet opening 20 in a free-standing manner and the gasket 22 in this case axially comes to bear against the flange plate 14 in a sealing manner. In principle, a combination wherein the gasket 22 comes to bear in a sealing manner both radially against the exhaust pipe 10 as well as axially against the flange plate 14 is also conceivable.

With the embodiment shown in FIG. 4 the exhaust manifold 9 is equipped with an outer shell 32, which largely envelopes the exhaust pipes 10. Consequently this is an air gap insulated exhaust manifold 9 with exhaust pipes 10 largely located inside. For fastening the exhaust pipes 10 or the exhaust manifold 9 to the flange plate 14 or to the outlet sockets 15, welding connections 33 are preferred. FIG. 4 exemplarily shows a welded connection 33 embodied as three-sheet seam, which interconnects each of the outlet socket 15, the exhaust pipe 10 and the outer shell 32.

According to FIG. 3, the flange plate 14 corresponding to the number of the cylinders 5 comprises a plurality of connecting sockets 15 which are integrally moulded on the flange plate 14. For example, the connecting sockets 15 are formed through deep drawing of a flat sheet metal blank. Each of the respective connecting sockets 15 thereby forms an enclosure of a socket opening 34 penetrating the flange plate 14.

In the example, the combustion engine 1 without restriction of the generality comprises four cylinders 5. Accordingly, the flange plate 14 in this case comprises four connecting sockets 15. On each connecting socket 15, one of the exhaust pipes 10 of the exhaust manifold 9 can be fastened.

As explained, the connecting plate 14 for its fixing to the combustion engine 1 comprises a plurality of through openings 19 through which screws or threaded rods for fastening the flange plate 14 or the flange 12 to the combustion engine 1 or to the engine block 4 can be inserted.

At least one of the connecting sockets 15 is formed in a connecting region 23. Preferably, a plurality of connecting sockets 15 are formed in such a connecting region 23 each. With the preferred embodiment shown here, all connecting sockets 15 are each formed in such a connection region 23. The respective connecting region 23 is characterized in that it is surrounded by a slit 24 which penetrates the flange plate 14. Here, the connecting regions 23 are not completely separated from the remaining flange plate 14, the respective slit 24 rather has at least one interruption 25. The slits 24 therefore do not completely surround the respective connecting region 23, but in each case with at least one interruption 25. In the region of the respective interruption 25 the respective connecting region 23 is connected to the remaining flange plate 14. In contrast with this, the respective connecting region 23 in the region of the remaining slit 24 is separated from the remaining flange plate 14.

As depicted the respective slit 24 runs within the flange plate 14 separately and at a distance from the socket openings 34. Additionally, the respective slit 24 runs within the flange plate 14 separately and at a distance from the through openings 19.

Furthermore, it is depicted that the respective slit 24 at its longitudinal endings 35 is closed or runs into another slit 24.

In the presented embodiment a width 36 as depicted in FIG. 3 of the respective slit 24 is at maximum of the same size as thickness 37 as depicted in FIG. 4 of the flange plate 14. Preferably, the width 36 of the slit 24 is smaller than the thickness 37 of the flange plate 14.

Particularly practical is the embodiment shown here, wherein the through openings 19 are arranged outside the respective connecting region 23, that is in the remaining flange plate 14. Because of this, relative movements between the connecting sockets 15 and the through openings 19 are made possible, since the connecting regions 23 largely cut free are moveable relative to the remaining flange plate 14 because of the slits 24.

With the embodiment shown here the interruptions 25 of the slits 24 are each arranged in a region which with respect to the respective connecting socket 15 is located approximately radially between the respective connecting socket 15 and a through opening 19 adjacent thereto. Furthermore, the respective slits 24 largely extend coaxially or concentrically to the respective connecting socket 15. Thus, the slits 24 each have at least one circular arc shaped portion 26, which extends coaxially to the respective connecting socket 15.

With the embodiment shown in FIG. 4 the pressure plate 16 covers the slit 24 or the slit portion 26.

With the embodiment shown in FIG. 3 the respective connecting region 23 additionally comprises at least one tongue 27, which extends from the associated connecting socket 15 in the direction of the adjacent connecting socket 15. Here, the tongues substantially extend radially to the respective connecting socket 15. The respective tongue 27 is surrounded by the associated slit 24 practically without interruption. Thus, the tongues 27 are largely freely moveable relative to the remaining flange plate 14.

In addition, the tongues 27 can be so dimensioned that in the region of such a tongue 27 the slits 24 of adjacent connecting regions 23 merge into each other. A corresponding transition region or contact region is designated 28 in FIG. 3. In addition or alternatively the tongues 27 can be shaped so that the slits 24 of connecting regions 23 adjacent thereto have a common portion 29. For example, with the embodiment shown in FIG. 3, the two tongues 27 of the two connecting regions 23 located inside abut each other along such a common portion 29.

Furthermore, according to the embodiment shown here, at least one such connecting region 23 can comprise a connecting web 30 in the region of such an interruption 25. The respective connecting web 30 substantially extends radially with respect to the associated connecting socket 15, namely in the direction of an adjacent through opening 19. Furthermore, the respective connecting web 30 is laterally surrounded by slit portions 31, which can more preferably extend parallel to the respective connecting web 30. It is important hereby that said lateral slit portions 31 end in front of the respective through opening 19, so that the associated connecting region 23 via the respective connecting web 30 remains in connection with the remaining flange plate 14.

In the case of a thermal load in the region of the flange connection 13 the flange 12 expands differently to the combustion engine 1 or to the engine block 4. This results in relative movements of the exhaust pipes 10 relative to the engine block 4, which can be largely compensated by the flange plate 14 introduced here. While the through openings 19 via the screw connection within the flange connection 13 are connected to the engine block 4 in a fixed manner, the exhaust pipes 10 are connected to the connecting sockets 15 in a fixed manner. The connecting sockets 15 however are each arranged in a connecting region 23 which because of the respective slit 24 is moveable relative to the remaining flange plate 14. Because of this, in operation of the combustion engine 1, relative movements between the exhaust pipes 10 and the engine block 4 can develop, which occur in the elastic range of the connecting plate 14 and are thus reversible, which reduces the danger of permanent damages. At the same time, the danger of a buckling formation in the respective connecting region 23 is clearly reduced, which could result in undesirable leakages of the hot exhaust gases.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A flange plate for connecting exhaust pipes to a combustion engine, comprising:

at least two connecting sockets integrally moulded on the flange plate, to which in each case an exhaust pipe can be fastened;

a plurality of through openings for fixing the flange plate to the combustion engine;

wherein at least one of the connecting sockets is formed in a connecting region surrounded by a slit penetrating the flange plate;

wherein the respective slit comprises at least one interruption;

wherein the respective connecting region is connected to the remaining flange plate in the region of the respective interruption;

wherein a width of the respective slit is smaller than a thickness of the flange plate or is at maximum of the same size as a thickness of the flange plate; and wherein the connecting region and the at least one connecting socket are movable independently of and relative to the remaining flange plate.

2. The flange plate according to claim 1, wherein the respective slit runs within the flange plate separately and at a distance from socket openings, wherein each socket opening is enclosed by one of the connecting sockets and is penetrating the flange plate.

3. The flange plate according to claim 1, wherein the respective slit runs within the flange plate separately and at a distance from the through openings.

4. The flange plate according to claim 1, wherein the respective slit at its longitudinal endings is closed or runs into another slit.

5. The flange plate according to claim 1, wherein the through openings are arranged outside the respective connecting region in the remaining flange plate.

6. The flange plate according to claim 1, wherein a plurality of connecting sockets are each formed in respective connecting regions.

7. The flange plate according to claim 1, wherein all connecting sockets are each formed in respective connecting regions.

8. The flange plate according to claim 1, wherein at least one such interruption is arranged between the respective connecting socket and a through opening adjacent thereto.

9. The flange plate according to claim 1, wherein at least one such slit comprises at least one circular arc shaped portion which is arranged coaxially to the respective connecting socket.

10. The flange plate according to claim 1, wherein at least one such connecting region comprises at least one tongue, which extends from the associated connecting socket in the direction of an adjacent connecting socket.

11. The flange plate according to claim 10, wherein the respective slit surrounds the respective tongue without interruption.

12. The flange plate according to claim 10, wherein in the region of such a tongue the slits of the associated adjacent connecting regions merge into each other and/or have a common portion.

13. The flange plate according to claim 1, wherein at least one such connecting region in the region of at least one such interruption comprises a connecting web, which with respect to the associated connecting socket extends radially in the direction of an adjacent through opening and which is laterally surrounded by slit portions.

14. The flange plate according to claim 13, wherein the slit portions extend parallel to the respective connecting web.

15. A flange connection for fastening an exhaust system on a combustion engine for connecting exhaust pipes to a combustion engine, comprising a flange plate, wherein at least two connecting sockets are integrally moulded on the flange plate, to which in each case an exhaust pipe can be fastened, wherein the flange plate is provided with a plurality of through openings for fixing the flange plate to the combustion engine, wherein at least one of the connecting sockets is formed in a connecting region surrounded by a slit penetrating the flange plate, wherein the respective slit comprises at least one interruption, wherein the respective connecting region is connected to the remaining flange plate in the region of the respective interruption, wherein exhaust pipes of the exhaust system are fastened on the connecting sockets, wherein at least one pressure plate is arranged on the flange plate on a side facing away from the combustion engine and which is screwed to the combustion engine through the through openings of the flange plate;

wherein a width of the respective slit is smaller than a thickness of the flange plate or is at maximum of the same size as a thickness of the flange plate; and wherein the connecting region and the at least one connecting socket are movable independently of and relative to the remaining flange plate.

16. An exhaust manifold for discharging exhaust gas from a combustion engine, particularly of a motor vehicle, with a plurality of exhaust pipes each of which can be fluidically connected to a cylinder of the combustion engine, with a flange plate for connecting exhaust pipes to a combustion engine, wherein at least two connecting sockets are integrally moulded on the flange plate, to which in each case an exhaust pipe can be fastened, wherein the flange plate is provided with a plurality of through openings for fixing the flange plate to the combustion engine, wherein at least one of the connecting sockets is formed in a connecting region surrounded by a slit penetrating the flange plate, wherein the respective slit comprises at least one interruption, wherein the respective connecting region is connected to the remaining flange plate in the region of the respective interruption, wherein the connecting sockets are connected to the exhaust pipes in a fixed manner;

wherein a width of the respective slit is smaller than a thickness of the flange plate or is at maximum of the same size as a thickness of the flange plate; and wherein the connecting region and the at least one connecting socket are movable independently of and relative to the remaining flange plate.

* * * * *